US009068568B2

(12) United States Patent
Heitz et al.

(10) Patent No.: US 9,068,568 B2
(45) Date of Patent: Jun. 30, 2015

(54) INLET CUTBACKS FOR HIGH SPEED GEAR PUMP

(75) Inventors: Steven A. Heitz, Rockford, IL (US); Weishun Ni, Rockton, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 212 days.

(21) Appl. No.: 13/555,902

(22) Filed: Jul. 23, 2012

(65) Prior Publication Data

US 2014/0023545 A1 Jan. 23, 2014

(51) Int. Cl.
*F04C 2/18* (2006.01)
*F04C 15/06* (2006.01)
*F04C 2/08* (2006.01)

(52) U.S. Cl.
CPC . *F04C 2/086* (2013.01); *F04C 2/18* (2013.01); *F04C 15/06* (2013.01); *F04C 2250/101* (2013.01)

(58) Field of Classification Search
CPC ..... F04C 15/0026; F04C 15/06; F04C 2250/101; F04C 2/086; F04C 2/18; F01C 1/18
USPC ..... 418/191, 206.4, 71, 74, 81
See application file for complete search history.

(56) References Cited

U.S. PATENT DOCUMENTS

| | | | | |
|---|---|---|---|---|
| 1,976,227 | A | | 10/1934 | Howard |
| 2,884,864 | A | | 5/1959 | Bobnar |
| 3,063,378 | A | | 11/1962 | Hart |
| 3,285,188 | A | * | 11/1966 | Kita ..... 418/74 |
| 3,680,990 | A | * | 8/1972 | Pettibone et al. ..... 418/178 |
| 3,713,759 | A | | 1/1973 | Pollman et al. |
| 4,239,468 | A | | 12/1980 | Smith |
| 4,631,009 | A | | 12/1986 | Cygnor et al. |
| 4,682,938 | A | | 7/1987 | Riordan |
| 4,729,727 | A | | 3/1988 | Aarestad |
| 5,324,183 | A | | 6/1994 | Capelle |
| 7,878,781 | B2 | | 2/2011 | Elder |
| 7,922,468 | B2 | | 4/2011 | Chang |
| 8,137,085 | B2 | | 3/2012 | Ni et al. |
| 2009/0148333 | A1 | * | 6/2009 | Elder ..... 418/206.7 |
| 2010/0158738 | A1 | * | 6/2010 | Heitz ..... 418/206.1 |
| 2010/0158739 | A1 | * | 6/2010 | Ni et al. ..... 418/206.5 |

FOREIGN PATENT DOCUMENTS

| | | | |
|---|---|---|---|
| GB | 857046 | A | 12/1960 |
| JP | 2007315211 | A | 12/2007 |

OTHER PUBLICATIONS

Intellectual Property Office, UK Search Report, Feb. 3, 2014, 6 pages.

* cited by examiner

*Primary Examiner* — Mary A Davis
*Assistant Examiner* — Paul Thiede
(74) *Attorney, Agent, or Firm* — Kinney & Lange, P.A.

(57) ABSTRACT

A gear pump comprises first and second gears and a housing. The housing comprises a first arcuate gear bore that receives the first gear, a second arcuate gear bore that receives the second gear, a discharge port that joins the first and second arcuate gear bores, an inlet port that joins the first and second arcuate gear bores opposite the discharge port; and first and second cutbacks that are joined to the first and second arcuate gear bores, respectively, adjacent the inlet port.

14 Claims, 6 Drawing Sheets

INLET CUTBACKS FOR HIGH SPEED GEAR PUMP

BACKGROUND

The present invention relates generally to high speed gear pumps and more particularly to inlet ports for gear pump housings.

Gear pumps comprise a species of positive displacement pumps in which two generally equally sized intermeshed gears rotate to convey a viscous liquid. The gears are mounted for rotation with their teeth intermeshing in a housing having an inlet port at one side of the intermeshed teeth and a discharge port on an opposite side of the intermeshed teeth. Rotation of the intermeshing gears draws in liquid through the inlet port. Inside the housing, the liquid is carried by each gear in gear pockets formed between adjacent gear teeth and the close clearance sealing zone within the housing. The liquid from each gear pocket is joined together at the discharge port and pushed from the housing. Rotation of the gear teeth away from each other at the inlet produces an increase of volume as the fluid is drawn into the gear pockets resulting in a pressure drop that draws liquid into the inlet port. Conversely, rotation of the gear teeth toward each other at the discharge port produces a decrease of volume in the pump housing that results in a pressure increase that pushes the liquid out the discharge port. The inlet port and discharge port are substantially isolated from each other by the intermeshing of the gear teeth between the inlet port and discharge port and engagement of the gears with the surfaces of the housing. Gear pumps are commonly used in aerospace applications for fuel and lubricating systems.

Operation of the gear pump at elevated speeds for aerospace applications increases the inlet dynamic pressure, which can cause cavitation erosion. In order to facilitate rotation of the gears within the housing, side bearings comprising flat plates are mounted adjacent the flat faces of the gears. Cavitation erosion frequently occurs on the side bearing faces adjacent to the intermeshed gear teeth, at the center of the gearteeth, and on the pump housing at the inlet port where the gear tooth tips enter the close clearance sealing zone with the housing. Cavitation erosion affects sealing of the gears with the side bearings and the pump housing. Cavitation erosion is caused by air trapped in the liquid being pumped by the gear teeth. Specifically, air and fluid vapor bubbles are introduced into the liquid as the gear teeth come out of mesh at the inlet port. As air and vapor within the liquid comes out of solution due to the vacuum created in the expanding gear mesh, the bubbles are driven to the center of the gear mesh by flow entering through passages in the bearing faces at the gear side faces. The fluid experiences a limiting drop in pressure as the velocity increases to fill the vacuum in the gear mesh. As the gear teeth continue to rotate out of mesh, the liquid pressure instantaneously increases at the inlet port due to a "hydraulic front" that causes the air to collapse back into solution. The implosion of the air produces a pressure shock that causes cavitation and damage to the pump components, which can be costly to repair or replace.

Cavitation damage is currently a limiting design factor in gear pumps used as fuel pumps in aircraft. Specifically, it is always generally desirable to reduce the size and weight of components used in aerospace applications. Smaller gear pumps can be used to achieve the desired output if operated at higher speeds. However, high speed operation of a pump decreases the inlet static pressure for a given fixed inlet total pressure with the aforementioned high inlet dynamic pressure. Reduced inlet static pressure in the expanding mesh introduces additional air bubbles into the liquid. Low pressure air travelling at high velocities can cause cavitation damage of the pump housing near the inlet. It is, therefore, desirable to eliminate cavitation damage produced during operation of high speed gear pumps.

SUMMARY

A gear pump comprises first and second gears and a housing. The housing comprises a first arcuate gear bore that receives the first gear, a second arcuate gear bore that receives the second gear, a discharge port that joins the first and second arcuate gear bores, an inlet port that joins the first and second arcuate gear bores opposite the discharge port; and first and second cutbacks that are joined to the first and second arcuate gear bores, respectively, adjacent the inlet port.

DETAILED DESCRIPTION

Figure 1:
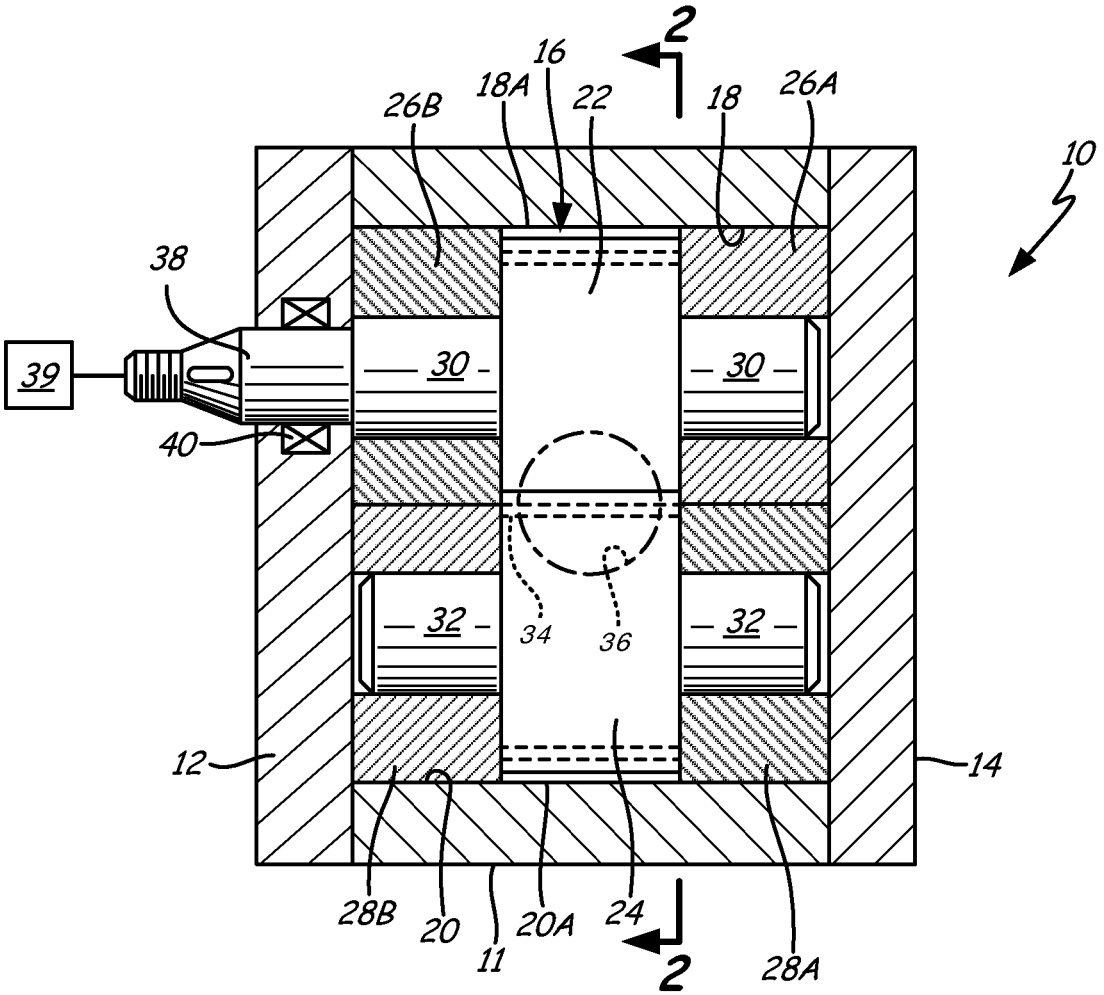
FIG. 1 is a top cross-sectional view of a gear pump showing a pair of gears between bearing plates in a pump housing.

FIG. 1 is a top cross-sectional view of gear pump 10 having housing 11 and end plates 12 and 14 that define pumping chamber 16. Pumping chamber 16 comprises gear bores 18 and 20, in which gears 22 and 24 are disposed, respectively. Gear pump 10 also includes bearing plates 26A and 26B and bearing plates 28A and 28B. First shaft 30 and second shaft 32 extend through bearing plates 26A and 26B and 28A and 28B, respectively, within housing 11. First gear 22 is mounted on first shaft 30 and second gear 24 is mounted on second shaft 32. Housing 11 includes inlet port 36 disposed adjacent engagement 34 of gear teeth of gears 22 and 24. Fluid is transferred from inlet port 36 to discharge port 42 by gear pockets 18A and 20A, which are formed by adjacent gear teeth and the close clearance with gear bores 18 and 20. Bearing plates 26A, 26B, 28A and 28B seal the ends of gear pockets 18A and 20A.

A means to drive pump 10 may be an engine driven gearbox or motor 39. Motor 39, such as a DC or AC electric motor, is joined to coupling 38 of first shaft 30 to induce rotation of first shaft 30 within bearings 26A and 26B. Fluid is sealed within the pump housing by seal 40. First shaft 30 rotates within sockets in bearing plates 26A and 26B. First gear 22 may be integral with shaft 30 or may be tightly fit or keyed onto first shaft 30 such that gear 22 rotates with shaft 30. Gear teeth of first gear 22 mesh with gear teeth of second gear 24 at engagement 36 to induce rotation of second gear 24. Second gear 24 may be integral with shaft 32 or may be tightly fit or keyed onto second shaft 32 such that shaft 32 rotates within sockets in bearing plates 28A and 28B.

Figure 2:
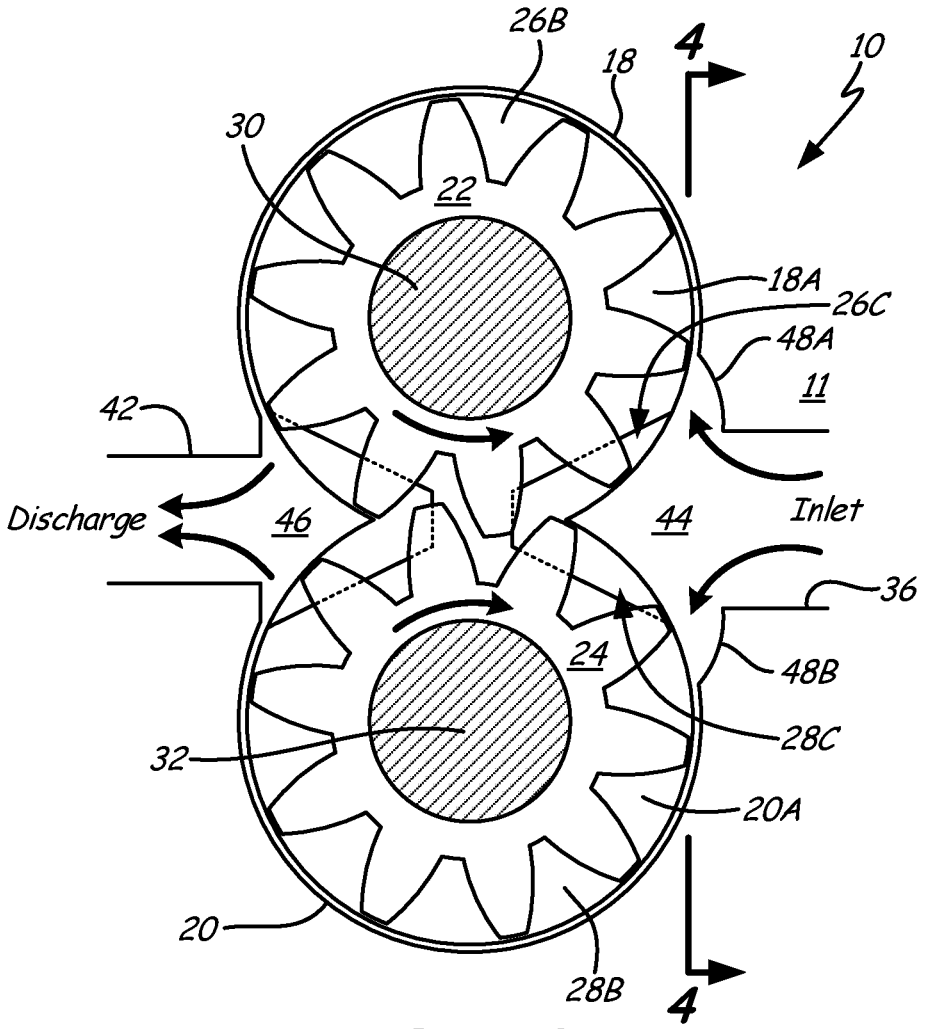
FIG. 2 is a side cross-sectional view of the gear pump as taken at section 2-2 of FIG. 1 showing intermeshing of the gears adjacent an inlet port having cutbacks of the present invention.

Rotation of gears 22 and 24 pulls a viscous liquid through inlet port 36 and pumps the fluid out of housing 11 at discharge port 42 (FIG. 2). Specifically, the liquid is routed along gear pockets 18A and 20A between inlet port 36 and discharge port 42. In order to facilitate entry of the liquid into the sides of the teeth of gears 22 and 24, bearing plates 26A, 26B, 28A and 28B include side fill indentations (not shown in FIG. 1), which are discussed with reference to FIG. 4. Furthermore, in the present invention, housing 11 includes inlet cutbacks (not shown in FIG. 1) that facilitate direct entry of the liquid into the gear tooth spaces from inlet port 36.

FIG. 2 is a side cross-sectional view of gear pump 10 of FIG. 1 showing intermeshing of gears 22 and 24 between inlet port 36 and discharge port 42 in housing 11. Housing 11 also includes cusps 44 and 46. Cusp 44 distributes fluid to expanding gear pockets 18A and 20A. Gear 22 rotates against bearing plate 26B, while gear 24 rotates against bearing plate 28B. Bearing plates 26B and 28B include face cuts 26C and 28C, respectively. Inlet port 36 includes cutbacks 48A and 48B that improve the ability of liquid entering inlet port 36 to travel into gear pockets 18A and 20A and fill the gear teeth. Inlet port 36 includes inlet bore 50.

Gears 22 and 24 are shown coupled to shafts 30 and 32, but may be integral therewith, respectively. The sides of gears 22 and 24 rotate against bearing plates 26B and 28B, respectively, while the tips of the gear teeth ride in close proximity with gear bores 18 and 20, respectively, to form gear pockets 18A and 20A. Bearing face cuts 26C and 28C provide a gap to permit fluid from inlet bore 50 to enter the gear teeth from the side faces of the gears 22 and 24. As shown in FIG. 2, gear 22 rotates counter-clockwise to move fluid from inlet bore 50 along gear bore 18 to discharge port 42. Gear 24 therefore rotates clockwise to move fluid from inlet bore 50 (FIG. 3) along gear bore 20 to discharge port 42. Cusp 46 collects the fluid expelled from gear pockets 18A and 20A and directs the fluid to discharge port 42. The bearing plates include bearing face cuts 26C and 28C to facilitate entry of fluid from inlet port 36 into the space between gear teeth through the sides of gears 22 and 24. Cutbacks 48A and 48B in the pump housing of the present invention permit fluid from inlet port 36 to more easily engage the centers of the teeth of gears 22 and 24, thereby reducing turbulence and cavitation damage. Any remaining bubbles are compressed to assure the tooth pockets 18A and 20A are completely filled with fluid assuring that cavitation does not occur in the discharge port of the pump.

Figure 3:
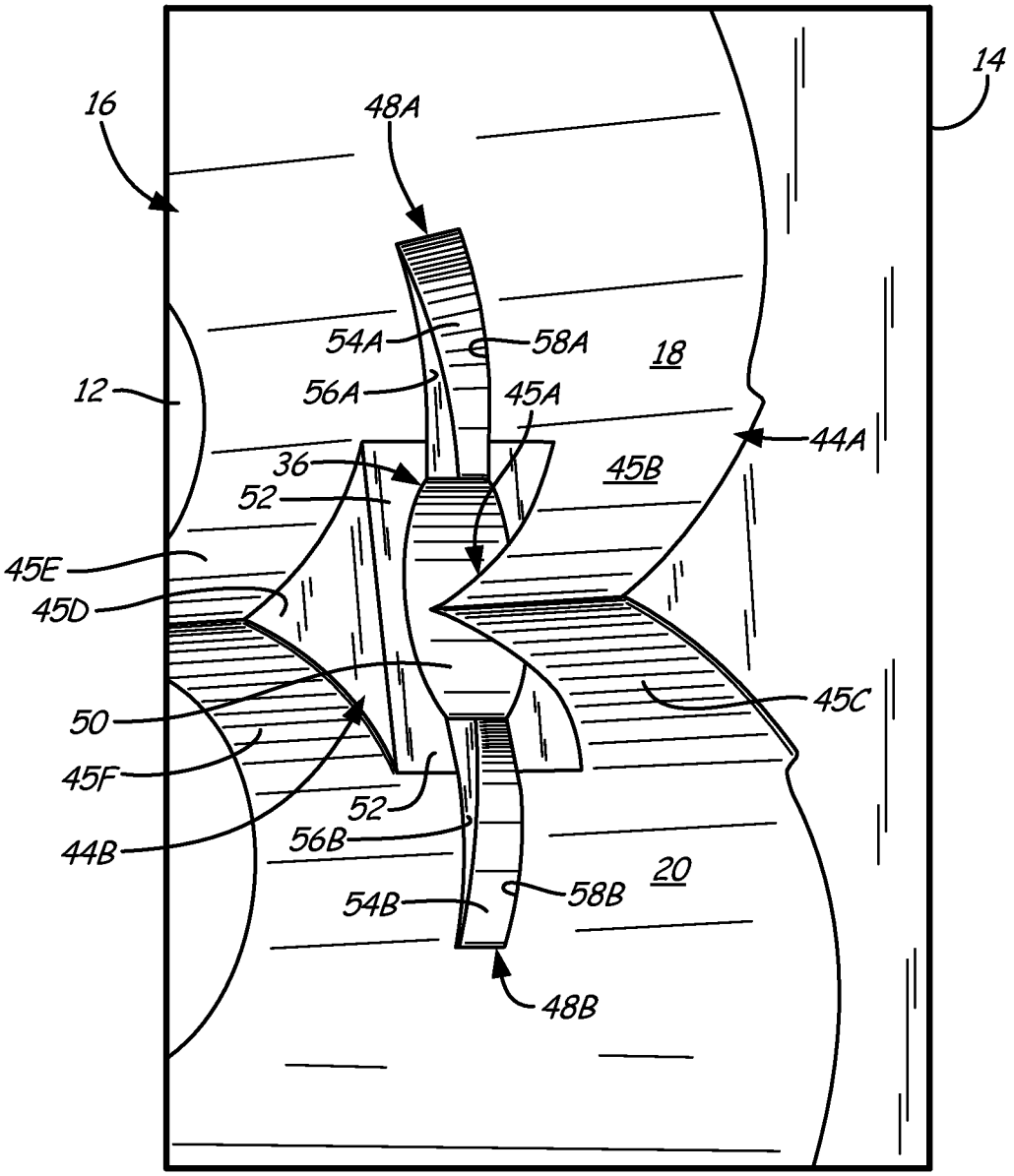
FIG. 3 is a perspective view of the housing of FIG. 2 showing cutbacks along the gear bores in an inlet pad adjacent the inlet port.

FIG. 3 is a perspective view of housing 11 of FIG. 2 showing cutbacks 48A and 48B along gear bores 18 and 20 adjacent inlet port 36. FIG. 3 shows the interior of housing 11 from FIG. 1 with end plate 14 and all internal components removed. As such, end plate 12 abuts housing 11 to form pumping chamber 16. Inlet port 36 includes inlet bore 50 and inlet pad 52 formed by cusp 44 shown in FIG. 2. Cutback 48A comprises ramp 54A, sidewall 56A and sidewall 58A. Cutback 48B comprises ramp 54B, sidewall 56B and sidewall 58B. Cusp 44 comprises inlet pad 52, inlet bore 50, first cusp portion 44A (which includes surfaces 45A, 45B and 45C) and second cusp portion 44B (which includes surfaces 45D, 45E and 45F). Walls 45A and 45D are formed by a machine cut across cusp portions 44A and 44B in housing bores 18 and 20 to create the surface of inlet pad 52. Although not shown in FIG. 3, when gear pump 10 is assembled, bearing plates 26A and 26B abut the gear side faces and is guided by surfaces of gear bore 18, and bearing plates 28A and 28B abut the gear side faces and is guided by surfaces of gear bore 20. Surfaces of cusp portions 44A and 44B are aligned with bearing face cut 28C (FIGS. 2 & 5) within gear bore 20 and bearing face cut 26C (FIGS. 2 & 5) within gear bore 18. Gears 22 and 24, although not shown in FIG. 3, are disposed between cusp portions 44A and 44B to ride along gear bores 18 and 20, respectively, such that the gear teeth intermesh adjacent bore 50 of inlet port 36.

Inlet pad 52 is formed into cusp 44 so as to be positioned between cusp portions 44A and 44B. In the embodiment shown, inlet pad 52 is perpendicular to the axis of bore 50 of inlet port 36. Thus, fluid traveling from inlet port 36 into pumping chamber 16 must typically make a ninety degree turn onto inlet pad 52 before turning slightly back toward the direction it came from to enter gear pockets 18A and 20A. Cutbacks 48A and 48B remove some of the turning required of the fluid to travel from inlet port 36 to gear pockets 18A and 20A. Specifically, ramps 54A and 54B of cutbacks 48A and 48B take out the acuteness of the turn between inlet pad 52 and gear pockets 18A and 20A (FIG. 2) and direct the fluid to the center on the gear mesh where the greatest deficit of fluid occurs.

Figure 4:
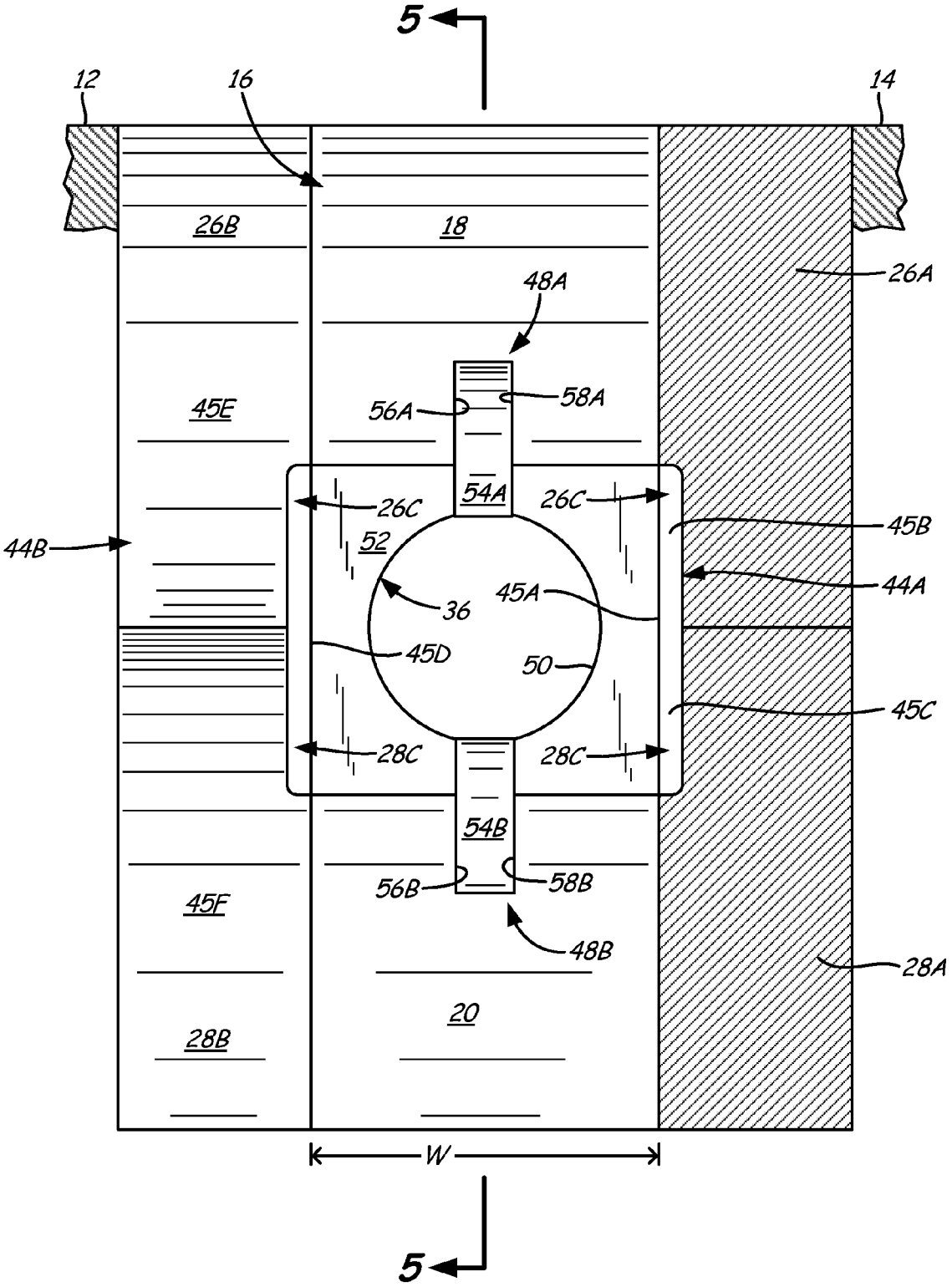
FIG. 4 is a front schematic view of the pump housing of the gear pump taken at section 4-4 of FIG. 2 showing the placement of inlet port cutbacks and bearing plate side fill indentations.

FIG. 4 is a front schematic view of pump housing 11 of gear pump 10 taken at section 4-4 of FIG. 2 showing the placement of inlet port cutbacks 48A and 48B and bearing face cuts 26C and 28C. FIG. 4 shows housing 11 and inlet port 36 of FIG. 3 with inlet pad 52 being parallel to the plane of FIG. 4. Bearing plates 26A and 28A are shown inserted into gear bores 18 and 20 adjacent cusp portion 44A. For comparison, cusp portion 44B is shown without bearing plates 26B and 28B.

Fluid entering housing 11 travels normal to the plane of FIG. 4 through inlet bore 50. In order to pressurize the fluid and separate inlet port 36 from discharge port 42 (FIG. 2), gear pump 10 operates to push fluid from inlet port 36 along gear pockets 18A and 20A, radially upward and radially downward in FIG. 4. Thus, it is desirable that the fluid enter the gear teeth of each gear with as little hydraulic loss as possible. Gears 22 and 24 (FIGS. 1 & 2) typically occupy the space between bearing plates 26A-26B and 28A-28B, which provide smooth surfaces against which to rotate. As is known in the art, the bearing plates can include features to permit entry of the fluid into the gear teeth at the side of the gears, as is discussed in U.S. Pat. No. 7,878,781 to Elder, which is assigned to Hamilton Sundstrand Corporation and is incorporated herein by this reference. As shown, bearing plates 26A and 28A include bearing face cuts 26C and 28C that reduce the width of their respective bearing plate to expose a flow path between the gear faces and the cusp portions 44A and 44B for filling the gear mesh from the sides or the gears. In various embodiments, bearing face cuts 26C and 28C comprise a recess, such as a channel or a pocket, in the face of the bearing plate that abuts the side of the gear. The recess may be bounded so as to form a "cup"-like structure or may comprise an angled surface extending to the edge of the bearing plate. As such, the seal between the bearing plate and the gear is broken to permit fluid from inlet port 36 around to the side of the gear. Such indentations are effective in filling the gear teeth in narrow gears or at low operational speeds, but can leave the center of the gear teeth under-filled and can cause bubbles to be carried to the outlet port where they will be collapsed resulting in cavitation and damage to the bearing faces and housing.

Inlet port cutbacks 48A and 48B fluidly couple inlet port 36 with gear bores 18 and 20 to improve fluid filling of the gear teeth of gear pockets 18A and 20A. In the described embodiment, cutbacks 48A and 48B comprise indentations into housing 11 which provide additional flow area into gear pockets 18A and 20A, respectively, and a smooth transition between bore 50 of inlet port 36 and gear pockets 18A and 20A. For example, cutback 48A includes ramp 54A that comprises a gently curved rectangular surface that extends from gear pocket 18A to a portion of inlet bore 50 that is recessed from inlet pad 52. As such, ramp 54A includes two four-sided side surfaces, surfaces 56A and 58A, that connect gear pocket 18A, ramp 54A, inlet pad 52 and inlet bore 50. In other embodiments, cutbacks 48A and 48B may be comprised of other shapes other than the "recessed rectangle" described herein. For example, cutbacks 48A and 48B may be recessed into gear bores 18 and 20 (so as to penetrate into gear pockets 18A and 20A) and using other shapes, such as triangles, circles, squares, trapezoids or parallelograms.

As shown, cutbacks 48A and 48B are located near the centers of gear bores 18 and 20. Cutbacks 48A and 48B need not be exactly at the center of inlet bore 50, but are spaced from bearing face cuts 26C and 28C to admit fluid preferentially to the centers of gear pockets 18A and 20A. Positioning cutbacks 48A and 48B near the center of inlet bore 50 also reduces leakage of fluid between discharge port 42 and inlet port 36. Cutbacks 48A and 48B are narrower than gears 22 and 24 or, as shown, narrower than the width W of inlet pad 52, which comprises the space between cusp portions 44A and 44B. The width of cutbacks 48A and 48B are sufficiently wide to permit filling of the gear teeth. As such, cutbacks 48A and 48B can be narrower if bearing face cuts 26C and 28C are effective in filling the gear tooth pockets, and wider if the gear pockets are not completely filled and the maximum operating speed and air content of the fluid are used. The width of cutbacks 48A and 48B can be wider than inlet port 36. The length and depth of cutbacks 48A and 48B are selected to minimize sharp bending between inlet bore 50 and gear bores 18 and 20, as is discussed with reference to FIG. 5.

Figure 5:
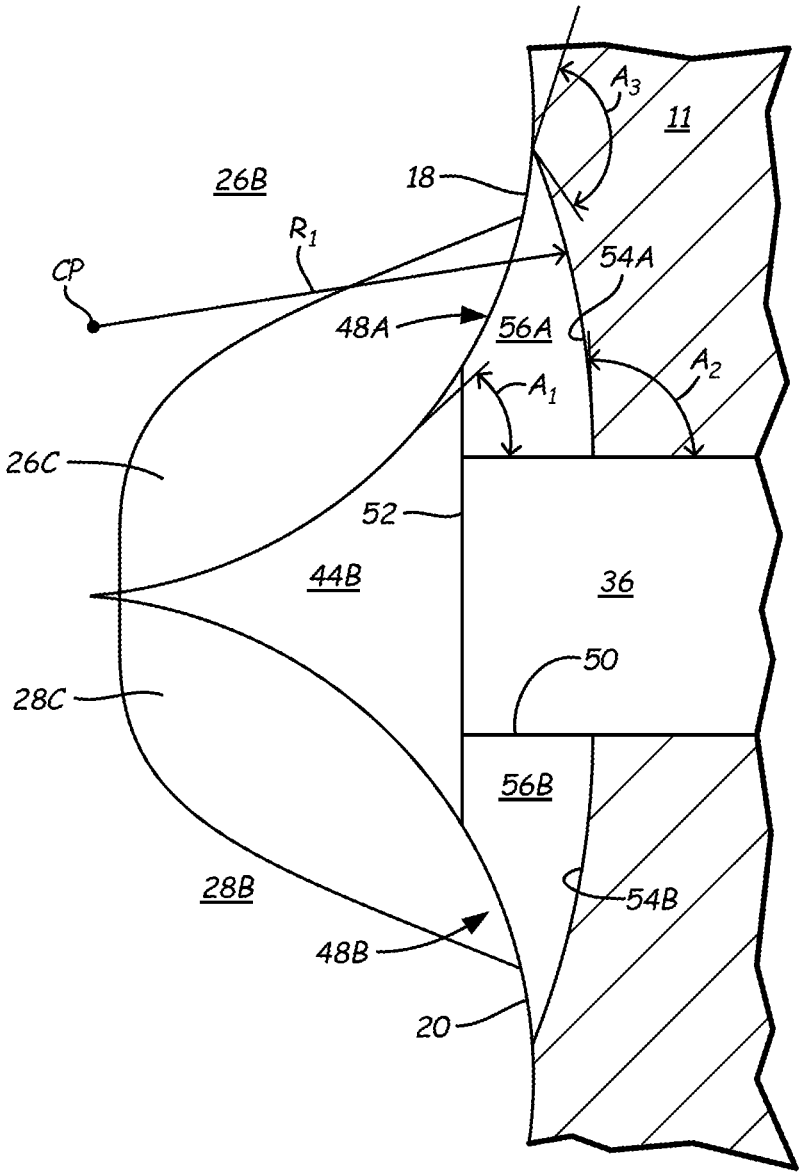
FIG. 5 is a side cross-section view of the inlet port taken at section 5-5 of FIG. 4 showing the orientation of the inlet port cutbacks relative to the gear pockets.
Figure 6:
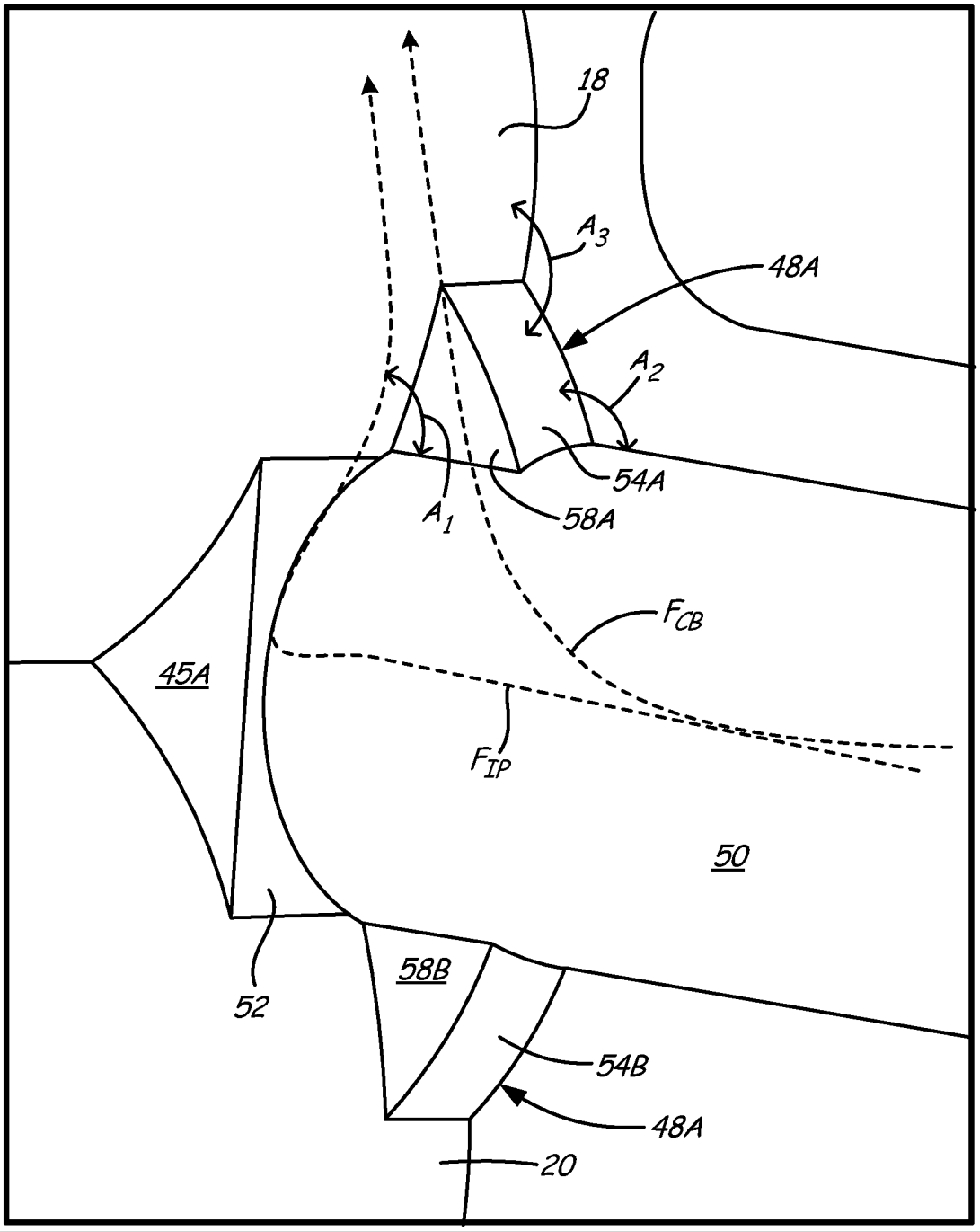
FIG. 6 is a rear view of the three-dimensional flow path formed by the inlet port and the cutbacks of FIG. 3 relative to the flow path formed by the inlet port and the inlet pad.

FIG. 5 is a close-up view of inlet port 36 taken as section 5-5 of FIG. 4 showing the orientation of inlet port cutbacks 48A and 48B relative to gear bores 18 and 20. FIG. 6 is a rear view of three-dimensional flow path $F_{CB}$ formed by inlet bore 50 of inlet port 36 and ramp 54A of cutback 48A of FIG. 3 relative to flow path $F_{IP}$ formed by inlet bore 50 and inlet pad 52 of inlet port 36. FIGS. 5 and 6 are discussed concurrently.

Inlet bore 50 extends through housing 11 to inlet pad 52. Thus, absent the inlet port cutbacks, fluid leaving bore 50 first makes a ninety degree outward turn to flow across a short, flat segment of inlet pad 52 as indicated by flow path $F_{IP}$ (FIG. 6). Next, the fluid turns upstream (with respect to the entry flow through inlet bore 50) against gear bores 18 and 20, as shown by flow path $F_{IP}$. With respect to gear bore 18, the fluid bends backwards across angle $A_1$ formed between the intersection of a line tangent to gear bore 18 at inlet pad 52 and the line of inlet bore 50, as illustrated. Typically, an inlet bore penetrates the gear pocket such that angle $A_1$ is an acute angle, thereby producing a ninety degree circle run, as is so designated in the art. Thus, the fluid must make multiple abrupt changes in flow path direction, which result in flow separation and inadequate fluid filling of the central portion of gear pockets 18A and 20A (FIG. 2). Flow separation at this location introduces vapor and air into the fluid that causes cavitation damage when later collapsed at high pressures within the pump, without the use of cutbacks 48A and 48B.

Cutbacks 48A and 48B of the present invention permit more complete filling of the gear teeth to reduce formation of vapor that causes cavitation damage. Within cutback 48A, near the center of inlet port 36, the fluid does not travel across inlet pad 52, but instead turns outward to flow across ramp 54A, before joining with gear pocket 18A in gear bore 18, as shown by flow path $F_{CB}$ (FIG. 6). The fluid bends across angle $A_2$, which is configured to be greater than ninety degrees near inlet bore 50 and slightly larger near gear pocket 18A at gear bore 18. Angle $A_2$ is formed between the line of inlet bore 50 and a line tangent to ramp 54A at its intersection with inlet bore 50. Thus, the fluid is directed gently downstream, toward the gears, across ramp 54A to gear pocket 18A in gear bore 18, as shown by flow path $F_{CB}$. The fluid then need only make a slight upstream turn at angle $A_3$ when flowing from ramp 54A to gear pocket 18A at gear bore 18. As shown, angle $A_3$ is large so as to be less than one-hundred-eighty degrees. Angle $A_3$ is formed between the intersection of the lines tangent to gear bore 18 and ramp 54A, as illustrated. In the disclosed embodiment, angles $A_2$ and $A_3$ are obtuse angles. Thus, cutbacks 48A and 48B are formed so that angles $A_2$ and $A_3$ are larger than angle $A_1$ to avoid the formation of ninety degree circle runs in the flow path of the fluid between inlet bore 50 and gear bores 18 and 20.

With reference to FIG. 5, the formation of angles $A_2$ and $A_3$ are determined by radius $R_1$. Radius R1 has a center point CP that is located within housing 11. More specifically, center point CP for forming cutback 48A is within gear bore 18 to provide access for a cutting tool. Centerpoint CP is, in any embodiment, at a different location than the center of gear bore 18. Cutback 48A comprises a circular arc that cuts into gear bore 18 and extends to inlet bore 50 to form ramp 54A. Cutback 48A is shown as being circular due to manufacturing considerations. For example, ramp 54A can be easily formed by a rotary cutting tool after housing 11 is manufactured. In other embodiments, cutback 48A need not have a circular shape. For example, cutback 48A can be formed so as to produce rounded edges where angles $A_2$ and $A_3$ are formed. In such embodiments, pump housing 11 is typically cast with inlet cutbacks as an integral feature.

The inlet cutbacks of the present invention provide a means for improving the filling of gear pockets at high pump speeds and in applications with high vapor and air content in the fluid. In particular, the inlet cutbacks permit filling of the gear teeth near the center of the gears. The central location of the inlet cutbacks draws fluid into the center of the gear teeth, which minimizes turbulence and vapor formation. The inlet cutbacks eliminate abrupt, sharp turns that would normally be present and that introduce turbulence that generates vapor formation. Furthermore, elimination of the sharp turns and the enlarged flow path area reduces the peak local velocity of the fluid at the center of the gear mesh resulting in a higher inlet static pressure and enhanced filling of the gear teeth. Thus, the present invention permits gear pumps to be operated at higher speeds and lower inlet static pressure without inducing cavitation damage.

The benefits of the inlet cutback also extend to aircraft lubrication and scavenging pumps. The scavenge pump is required to pump oil with high air content and low static pressures. The oil system is typically vented to the local ambient pressure at the altitude of the aircraft. Increased pumping capacity can be achieved with the inlet filling ramps presented in the present invention. The ramps may be extended axially and radially to accommodate higher inlet flows without increasing the size of the pumping elements.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s)

disclosed, but that the invention will include all embodiments falling within the scope of the appended claims.

The invention claimed is:

1. A gear pump comprising:

first and second gears; and a housing that includes:

a first generally circular wall defining a first arcuate gear bore for receiving the first gear, the first arcuate gear bore defining a first fluid path;

a second generally circular wall defining a second arcuate gear bore for receiving the second gear, the second arcuate gear bore defining a second fluid path;

a wall defining a discharge port in fluid communication with the first and second fluid paths;

a wall defining an inlet port generally opposite the discharge port and in fluid communication with the first and second fluid paths;

a first cutback region defined by a ramp and two sidewalls extending between the inlet port and the first circular wall; and a second cutback region defined by a ramp and two sidewalls extending between the inlet port and the second circular wall, wherein the first and second cutback regions have widths that are narrower than a width of the inlet port.

2. The gear pump of claim 1 and further comprising:

first and second shafts upon which the first and second gears are respectively mounted such that intermeshing teeth of the first and second gears are located between the inlet port and the discharge port.

3. The gear pump of claim 2 and further comprising:

a motor coupled to the first shaft, wherein the motor is configured to rotate teeth of the first and second gears.

4. The gear pump of claim 1 and further comprising:

a first bearing plate disposed between the first gear and a first end plate of the housing; and a second bearing plate disposed between the first gear and a second end plate of the housing.

5. The gear pump of claim 4 wherein the first inlet bearing plate and the second inlet bearing plate include side fill indentations adjacent the inlet port.

6. The gear pump of claim 5 wherein the first and second cutback regions are spaced from the side fill indentations.

7. The gear pump of claim 1 wherein the first and second cutback regions are centered on the inlet port.

8. The gear pump of claim 1 wherein the housing comprises:

a cusp located where the first circular wall and the second circular wall intersect near the inlet port; and an inlet pad comprising a planar surface extending into the cusp and through which an inlet bore in fluid communication with the inlet port extends;

wherein the first and second cutback regions are disposed in the first and second circular walls and extend through the inlet pad so that the first and second cutback regions allow fluid communication between the respective first and second fluid paths and the inlet port.

9. The gear pump of claim 8 wherein:

a first angle between the ramp of the first cutback region and the inlet bore is greater than a second angle between the first arcuate gear bore and the inlet bore.

10. The gear pump of claim 1 wherein the ramp of the first cutback region extends along a circular arc having a radial center disposed in the housing.

11. A gear pump housing comprising:

first and second circular walls defining:

a first arcuate gear bore for receiving a first gear;

a second arcuate gear bore for receiving a second gear; and an inlet cusp disposed in a region near where the first and second circular walls intersect;

a wall defining an inlet port that extends to the inlet cusp;

an inlet pad comprising a planar surface extending from the first circular wall to the second circular wall at the inlet cusp, wherein the inlet pad is configured to allow fluid to flow from the inlet port to the first and second gears; and a first cutback region defined by a ramp and two sidewalls extending between the inlet port and the first circular wall; and a second cutback region defined by a ramp and two sidewalls extending between the inlet port and the second circular wall, wherein the first and second cutback regions have widths that are narrower than a width of the inlet port.

12. The gear pump housing of claim 11 and further comprising:

a discharge cusp disposed in a region near where the first and second circular walls intersect, generally opposite the inlet cusp; and a wall defining a discharge port that extends to the discharge cusp.

13. The gear pump housing of claim 11 wherein the first and second cutback regions are centered on the inlet port.

14. The gear pump housing of claim 11 wherein:

a first angle between the ramp of the first cutback region and the inlet port is greater than a second angle between the first arcuate gear bore and the inlet port.

* * * * *